US009660340B2

(12) United States Patent
Yokoyama et al.

(10) Patent No.: US 9,660,340 B2
(45) Date of Patent: May 23, 2017

(54) MULTIBAND ANTENNA

(71) Applicant: Murata Manufacturing Co., Ltd., Kyoto (JP)

(72) Inventors: Michiharu Yokoyama, Kyoto (JP); Kaoru Sudo, Kyoto (JP); Ryuken Mizunuma, Kyoto (JP); Masayuki Nakajima, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 40 days.

(21) Appl. No.: 14/735,297

(22) Filed: Jun. 10, 2015

(65) Prior Publication Data

US 2015/0311589 A1 Oct. 29, 2015

Related U.S. Application Data

(63) Continuation of application No. PCT/JP2013/082027, filed on Nov. 28, 2013.

(30) Foreign Application Priority Data

Dec. 20, 2012 (JP) ..... 2012-278004

(51) Int. Cl.
*H01Q 5/321* (2015.01)
*H01Q 9/06* (2006.01)
(Continued)

(52) U.S. Cl.
CPC ..... *H01Q 5/321* (2015.01); *H01Q 1/38* (2013.01); *H01Q 5/35* (2015.01); *H01Q 9/065* (2013.01); *H01Q 9/30* (2013.01)

(58) Field of Classification Search
CPC ..... H01Q 5/321
See application file for complete search history.

(56) References Cited

U.S. PATENT DOCUMENTS 5,087,922 A 2/1992 Tang et al.
7,557,761 B2 * 7/2009 Iwai ..... H01Q 9/30 343/702
(Continued)

FOREIGN PATENT DOCUMENTS

CN 101719593 A 6/2010
CN 202150550 U 2/2012
(Continued)

OTHER PUBLICATIONS

International Search Report issued in Application No. PCT/JP2013/082027 dated Feb. 25, 2014.
(Continued)

*Primary Examiner* — Howard Williams
(74) *Attorney, Agent, or Firm* — Pearne & Gordon, LLP

(57) ABSTRACT

Two high frequency antennas are provided in a multilayer substrate. Each high frequency antenna is configured of a radiation element, a high frequency power supply line, and a high frequency power supply unit. A low frequency antenna is configured of a series radiation element, a low frequency power supply line, and a lower frequency power supply unit. The series radiation element is formed of two radiation elements connected by a radiation element connection line. One end side of the series radiation element is connected to the low frequency power supply unit via the low frequency power supply line. Open stubs to block transmission of a high frequency signal (SH) are connected to the radiation element connection line and the low frequency power supply line. Short stubs to block transmission of a low frequency signal (SL) are connected to the high frequency power supply lines.

5 Claims, 11 Drawing Sheets

(51) Int. Cl.

| | |
|---|---|
| ***H01Q 5/35*** | (2015.01) |
| ***H01Q 1/38*** | (2006.01) |
| ***H01Q 9/30*** | (2006.01) |

(56) References Cited

U.S. PATENT DOCUMENTS

| | | | | |
|---|---|---|---|---|
| 8,583,197 | B2 * | 11/2013 | Rofougaran | H01Q 5/00 370/329 |
| 9,077,084 | B2 * | 7/2015 | Li | H01Q 5/321 |
| 2011/0122039 | A1 | 5/2011 | Baba et al. | |
| 2012/0075158 | A1 | 3/2012 | Kawahata | |
| 2013/0162497 | A1 | 6/2013 | Satou | |
| 2013/0328742 | A1 | 12/2013 | Hirobe | |

FOREIGN PATENT DOCUMENTS

| | | | |
|---|---|---|---|
| JP | S55-93305 | A | 7/1980 |
| JP | 2004-266499 | A | 9/2004 |
| JP | 2007-006215 | A | 1/2007 |
| JP | 2007-068153 | A | 3/2007 |
| JP | 2009-089300 | A | 4/2009 |
| JP | 2011-055419 | A | 3/2011 |
| JP | 2012-227742 | A | 11/2012 |
| JP | 2012-244390 | A | 12/2012 |
| WO | 2010140427 | A1 | 12/2010 |

OTHER PUBLICATIONS

Translation of the Written Opinion issued in Application No. PCT/JP2013/082027 dated Feb. 25, 2014.

Chinese Office Action for Chinese Patent Application No. 201380067224.8 dated Aug. 26, 2016.

Extended European Search Report issued in Patent Application No. EP 13 86 4828 dated Sep. 20, 2016.

* cited by examiner

MULTIBAND ANTENNA

FIELD OF THE DISCLOSURE

The present disclosure relates to multiband antennas capable of being used for a plurality of signals of different frequency bands.

DESCRIPTION OF THE RELATED ART

Patent Document 1 discloses a microstrip antenna (patch antenna) provided with a radiation element and a ground layer that are opposed to each other with a dielectric, which is thin in comparison with the wave length, interposed therebetween, for example, and a passive element on a radiation surface side of the radiation element. Further, Patent Document 2 discloses a planar antenna device in which two power supply points are provided in an excitation element provided on a dielectric substrate, and which is capable of radiation of two kinds of polarized waves orthogonal to each other.

Patent Document 1: Japanese Unexamined Patent Application Publication No. 55-93305

Patent Document 2: Japanese Unexamined Patent Application Publication No. 2004-266499

BRIEF SUMMARY OF THE DISCLOSURE

The antennas disclosed in Patent Documents 1 and 2 are each configured as a single high frequency antenna and used in a single band, adjacent band, or the like. In the meantime, the technique of multiband which can be used in a plurality of bands of different frequency bands is increasingly employed in communications these days. As such, it is inefficient to use antennas only in a single band, adjacent band, or the like.

The present disclosure has been conceived in view of the above-described issue of the past technique, and the present disclosure provides multiband antennas that can be used for a plurality of signals of different frequency bands.

(1) In order to solve the above issue, a multiband antenna according to the present disclosure includes: at least two radiation elements; high frequency power supply units configured to supply high frequency signals to the respective radiation elements; radiation element connection lines for connecting the radiation elements in series to form a series radiation element; a low frequency power supply unit connected to one end side of the series radiation element via a low frequency power supply line and configured to supply a low frequency signal; and high frequency blocking circuits connected to the radiation element connection lines and the low frequency power supply line, and configured to block transmission of the high frequency signal. In the stated multiband antenna, the high frequency signal is radiated from each of the radiation elements and the low frequency signal is radiated from the series radiation element.

According to the present disclosure, supplying a high frequency signal from the high frequency power supply unit to the radiation element makes it possible to radiate a high frequency signal from the radiation element. Meanwhile, supplying a low frequency signal from the low frequency power supply unit to the series radiation unit makes it possible to radiate a low frequency signal from the series radiation element.

Since the high frequency blocking circuits are connected to the radiation element connection lines and the low frequency power supply line, the transmission of the high frequency signal in the radiation element connection lines and the low frequency power supply line can be blocked by high frequency signal blocking circuits. At this time, the series radiation element is recognized as mismatching in the high frequency signal band. Because of this, although the series radiation element is configured by connecting the radiation elements in series, each of the radiation elements can function independently, whereby a multiband antenna capable of being used for a plurality of signals of different frequency bands can be configured.

(2) In the present disclosure, the radiation elements and the high frequency power supply units are connected by high frequency power supply lines, and low frequency signal blocking circuits configured to block transmission of the low frequency signal are connected to each of the high frequency power supply lines.

According to the present disclosure, since the low frequency signal blocking circuits are connected to the high frequency power supply lines, the transmission of the low frequency signal in the high frequency power supply lines can be blocked by the low frequency signal blocking circuits. At this time, because the high frequency power supply unit is recognized as mismatching in the low frequency signal band, the low frequency signal will not reach the high frequency power supply unit through the high frequency power supply line. This makes it possible to configure a series radiation element used for low frequency signals by connecting a plurality of radiation elements in series.

(3) In the present disclosure, the radiation element comprises a patch antenna.

According to the present disclosure, since the radiation element comprises a patch antenna, it is possible to transmit or receive high frequency signals using a small patch antenna.

(4) In the present disclosure, a length between the other end of the series radiation element and the low frequency power supply unit is set to a dimension such that the low frequency signal resonates in a plurality of modes, and low frequency signals of different wave lengths are radiated from the series radiation element.

According to the present disclosure, since the length between the other end of the series radiation element and the low frequency power supply unit is set to a dimension such that the low frequency signal resonates in a plurality of modes, low frequency signals of different wave lengths corresponding to the plurality of modes can be radiated from the series radiation element.

(5) In the present disclosure, at least one matching circuit in place of the high frequency blocking circuit is provided to any one of the radiation element connection lines, and low frequency signals of different wave lengths are radiated from the series radiation element.

According to the present disclosure, because at least one matching circuit in place of the high frequency blocking circuit is provided to any one of the radiation element connection lines, the series radiation element resonates to a low frequency signal at a portion between the matching circuit and the low frequency power supply unit and also resonates to a low frequency signal of another wave length on the whole series radiation element. As such, low frequency signals of different wave lengths can be radiated from the series radiation element.

(6) A multiband antenna according to the present disclosure includes: at least two radiation elements; high frequency power supply units configured to supply high frequency signals to the respective radiation elements; passive elements that are provided opposing the respective radiation elements; passive element connection lines that connect the passive elements in series to form a series passive element; a low frequency power supply unit connected to one end side of the series passive element via a low frequency power supply line and configured to supply a low frequency signal; and high frequency blocking circuits that are connected to the passive element connection lines and the low frequency power supply line, and configured to block transmission of the high frequency signal. In the stated multiband antenna, the high frequency signal is radiated from each of the radiation elements and the low frequency signal is radiated from the series passive element.

According to the present disclosure, supplying a high frequency signal from the high frequency power supply unit to the radiation element makes it possible to radiate a high frequency signal from the radiation element. Here, since the passive elements are provided opposing the radiation elements, it is possible to further widen the band of the high frequency antenna in comparison with a case where the passive elements are omitted. Meanwhile, supplying a low frequency signal from the low frequency power supply unit to the series passive element makes it possible to radiate a low frequency signal from the series passive element.

Since the high frequency blocking circuits are connected to the passive element connection lines and the low frequency power supply line, the transmission of the high frequency signal in the passive element connection lines and the low frequency power supply line can be blocked by high frequency signal blocking circuits. At this time, the series passive element is recognized as mismatching in the high frequency signal band. Because of this, although the series passive element is configured by connecting the passive elements in series, each of the passive elements can function independently, whereby a multiband antenna capable of being used for a plurality of signals of different frequency bands can be configured.

(7) In the present disclosure, the radiation elements and the high frequency power supply units are connected by high frequency power supply lines, and low frequency signal blocking circuits configured to block transmission of the low frequency signal are connected to each of the high frequency power supply lines.

According to the present disclosure, since the low frequency signal blocking circuits are connected to the high frequency power supply lines, the transmission of the low frequency signal in the high frequency power supply lines can be blocked by the low frequency signal blocking circuits. At this time, because the high frequency power supply unit is recognized as mismatching in the low frequency signal band, the low frequency signal will not reach the high frequency power supply unit through the high frequency power supply line. This makes it possible to configure a series passive element for low frequency signals by connecting the plurality of passive elements in series.

(8) In the present disclosure, there is provided an insulation layer between the radiation elements and the series passive element.

According to the present disclosure, since the insulation layer is provided between the radiation elements and the series passive element, the radiation elements and the series passive element can be laminated with the insulation layer interposed therebetween. This makes it possible to form the radiation elements, the series passive element, and the like on the multilayer substrate.

(9) In the present disclosure, a length between the other end of the series passive element and the low frequency power supply unit is set to a dimension such that the low frequency signal resonates in a plurality of modes, and low frequency signals of different wave lengths are radiated from the series passive element.

According to the present disclosure, since the length between the other end of the series passive element and the low frequency power supply unit is set to a dimension such that the low frequency signal resonates in a plurality of modes, low frequency signals of different wave lengths corresponding to the plurality of modes can be radiated from the series passive element.

(10) In the present disclosure, at least one matching circuit in place of the high frequency blocking circuit is provided to any one of the passive element connection lines, and low frequency signals of different wave lengths are radiated from the series passive element.

According to the present disclosure, since at least one matching circuit in place of the high frequency blocking circuit is provided to any one of the passive element connection lines, the series passive element resonates to a low frequency signal at a portion between the matching circuit and the low frequency power supply unit and also resonates to a low frequency signal of another wave length on the whole series passive element. As such, low frequency signals of different wave lengths can be radiated from the series passive element.

DETAILED DESCRIPTION OF THE DISCLOSURE

Figure 1:
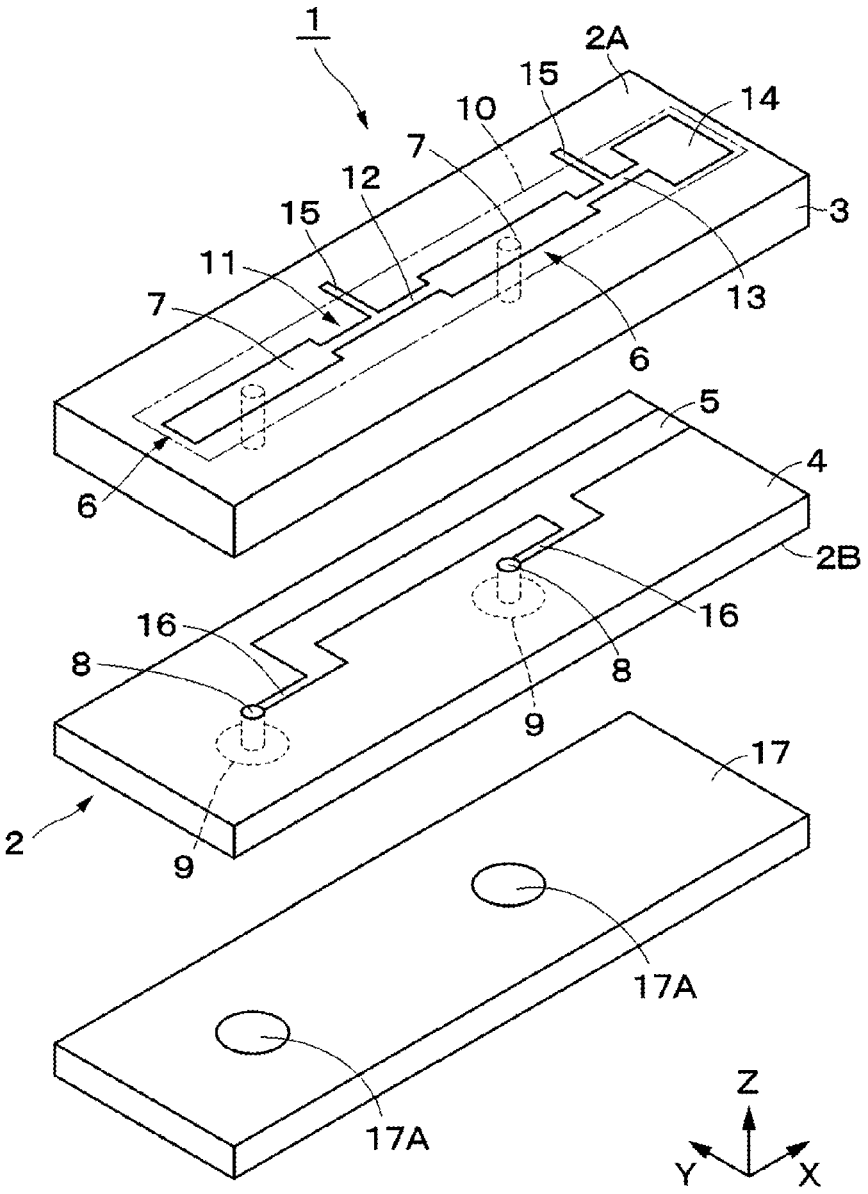
FIG. 1 is an exploded perspective view illustrating a multiband antenna according to a first embodiment.

Hereinafter, multiband antennas according to embodiments of the present disclosure will be described in detail with reference to the accompanying drawings.

A multiband antenna 1 according to a first embodiment is shown in FIGS. 1 through 4. The multiband antenna 1 includes a multilayer substrate 2, high frequency antennas 6, a low frequency antenna 10, open stubs 15, short stubs 16, and so on.

The multilayer substrate 2 is formed in a plate shape parallel to an X-Y plane extending in an X-axis direction and a Y-axis direction among the X-axis direction, the Y-axis direction, and a Z-axis direction perpendicular to one another. The multilayer substrate 2 is a print board in which two layers, that is, thin insulative resin layers 3 and 4 are laminated as insulation layers in a direction from a front surface 2A side toward a rear surface 2B side, for example. A ground layer 5 formed with a conductive thin film of copper, silver, or the like is provided between the resin layers 3 and 4, and is connected to an external ground.

Although a resin substrate is given as an example of the multilayer substrate 2, the multilayer substrate 2 is not limited thereto, and may be a ceramic multilayer substrate in which insulative ceramic layers are laminated as insulation layers or may be a low temperature co-fired ceramic multilayer substrate (LTCC multilayer substrate).

The high frequency antenna 6 is a dipole antenna for a high frequency signal SH of 60 GHz band which is used in WiGig (Wireless Gigabit), for example. The high frequency antenna 6 includes a radiation element 7, a high frequency power supply line 8, and a high frequency power supply unit 9.

The radiation element 7 has a length dimension of a half wavelength of the high frequency signal SH in the X-axis direction, for example. The radiation element 7 is formed with an elongate belt-like conductor pattern (metal thin film) and provided on the front surface 2A of the multilayer substrate 2. The high frequency power supply line 8 formed of a via penetrating through the multilayer substrate 2 in a thickness direction thereof (Z-axis direction) is connected to a central portion of the radiation element 7. Note that the via is a columnar conductor where a conductive material such as copper, silver, or the like is provided in a through-hole whose inner diameter is approximately several tens to hundreds of μm, for example.

Further, a plurality of the high frequency antennas 6 (for example, two antennas) are provided in the multilayer substrate 2. The radiation elements 7 of the high frequency antennas 6 linearly extend being aligned in the X-axis direction. The high frequency antenna 6 is not limited to a dipole antenna, and may be a monopole antenna or a linear antenna in another form.

The high frequency power supply units 9 are each provided on the rear surface 2B of the multilayer substrate 2 at a position opposing the radiation element 7 of each of the high frequency antennas 6. The number of the high frequency power supply units 9 is the same as that of the high frequency antennas 6. The high frequency power supply unit 9 is formed with an electrode pad made of a metal thin film, for example, and electrically connected to the radiation element 7 via the high frequency power supply line 8. The high frequency power supply unit 9 comprises an input/output terminal of the high frequency signal SH and supplies the high frequency signal SH of 60 GHz band to the high frequency antenna 6. Note that the high frequency power supply unit 9 can take any form as long as it supplies the high frequency signal SH. As such, the high frequency power supply unit 9 may be a detachable member such as a connector, probe, or the like, a member capable of being jointed by soldering or the like, a component configured to generate the high frequency signal SH, or the like.

The low frequency antenna 10 is a monopole antenna for a low frequency signal SL at a lower frequency rather than the high frequency signal SH (for example, several GHz to several tens of GHz). The low frequency antenna 10 includes a series radiation element 11, a low frequency power supply line 13, and a low frequency power supply unit 14.

The series radiation element 11 is formed by connecting the plurality of radiation elements 7 in series and is provided on the front surface 2A of the multilayer substrate 2. In this case, two adjacent radiation elements 7 are connected by a radiation element connection line 12. In addition, the low frequency power supply unit 14 is connected to one end side of the series radiation element 11 (right end side of the series radiation element 11 in FIG. 2) via the low frequency power supply line 13.

The radiation element connection line 12 and the low frequency power supply line 13 are each formed with an elongate belt-like conductor pattern and provided on the front surface 2A of the multilayer substrate 2. In this case, a length between the other end of the series radiation element 11 and the low frequency power supply unit 14 is set to a dimension of a quarter wavelength of the low frequency signal SL in the X-axis direction, for example.

Figure 2:
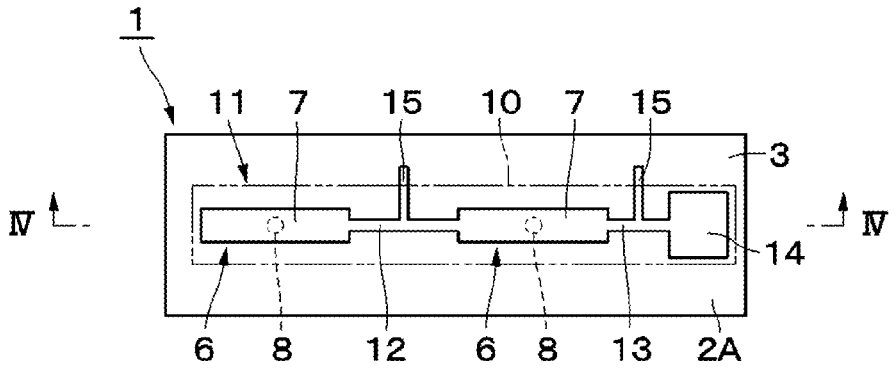
FIG. 2 is a plan view illustrating the multiband antenna shown in FIG. 1.
Figure 3:
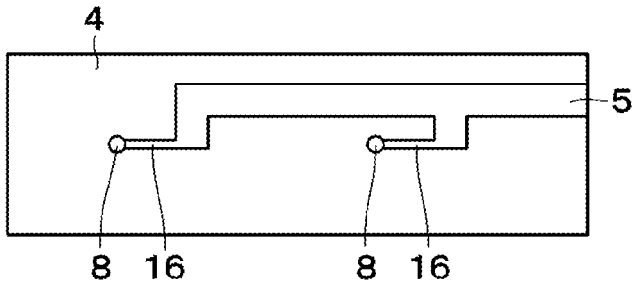
FIG. 3 is a plan view illustrating a ground layer shown in FIG. 1.
Figure 4:
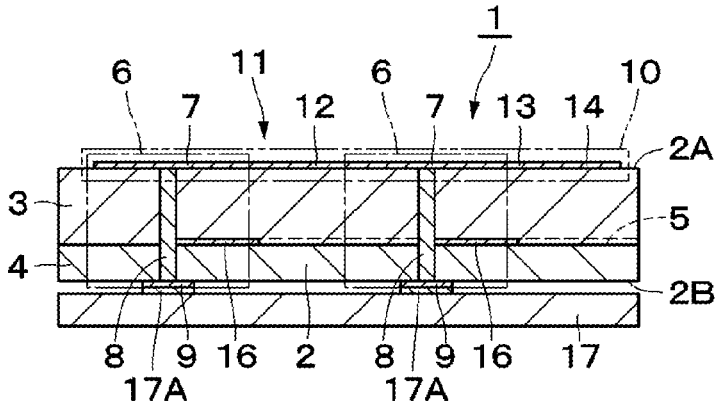
FIG. 4 is a cross-sectional view of the multiband antenna taken along an arrow direction of IV-IV in FIG. 2.
Figure 5:
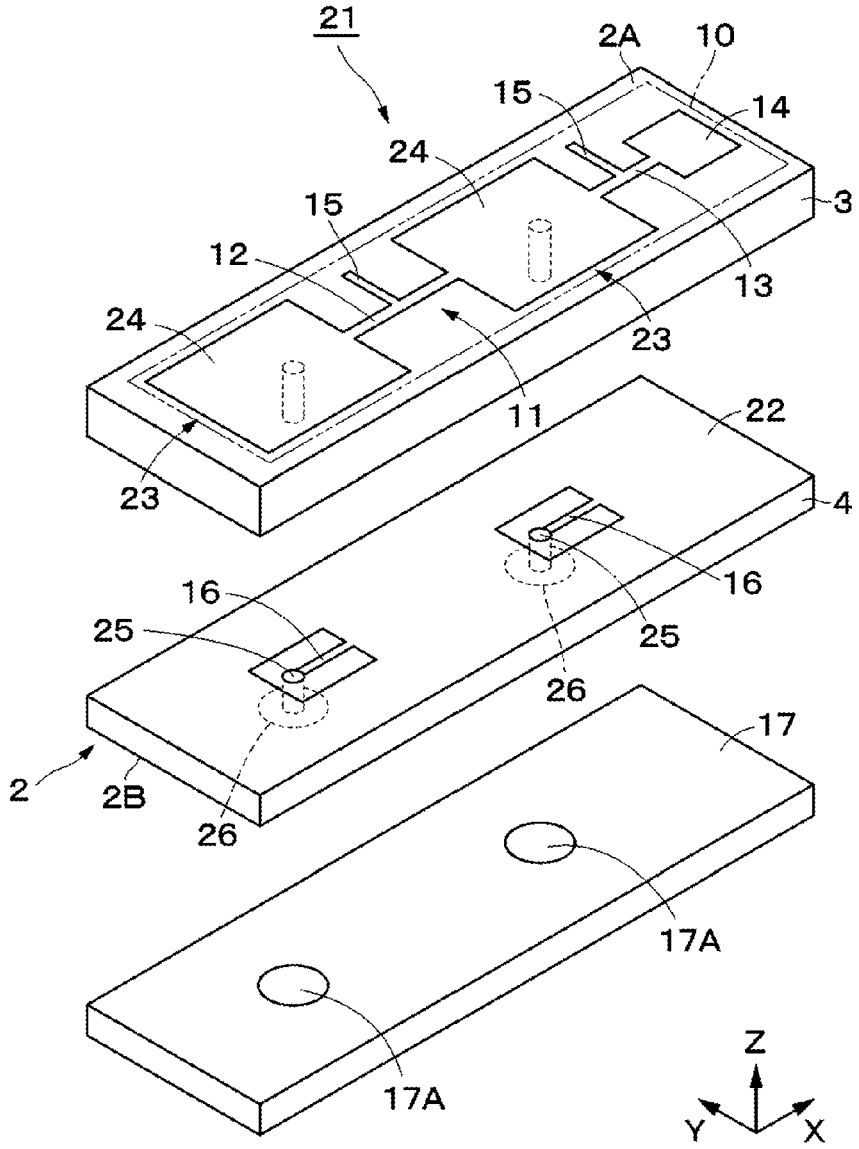
FIG. 5 is an exploded perspective view illustrating a multiband antenna according to a second embodiment.
Figure 6:
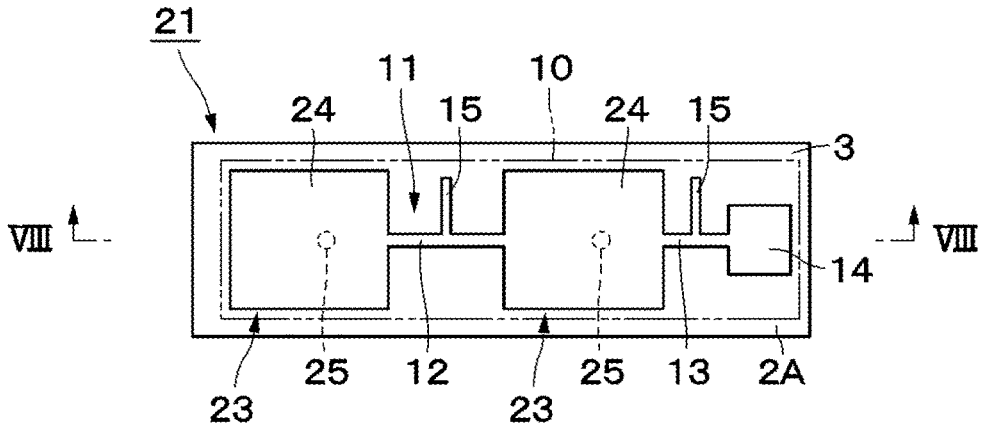
FIG. 6 is a plan view illustrating the multiband antenna shown in FIG. 5.
Figure 7:
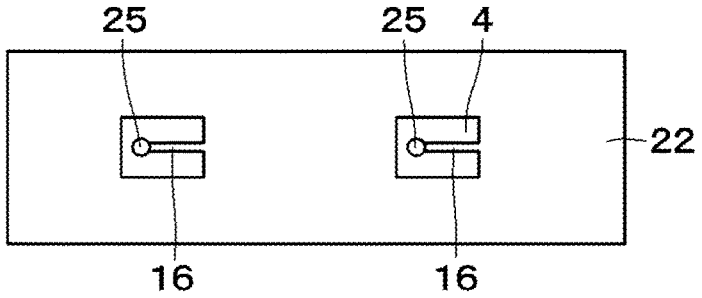
FIG. 7 is a plan view illustrating a ground layer shown in FIG. 5.
Figure 8:
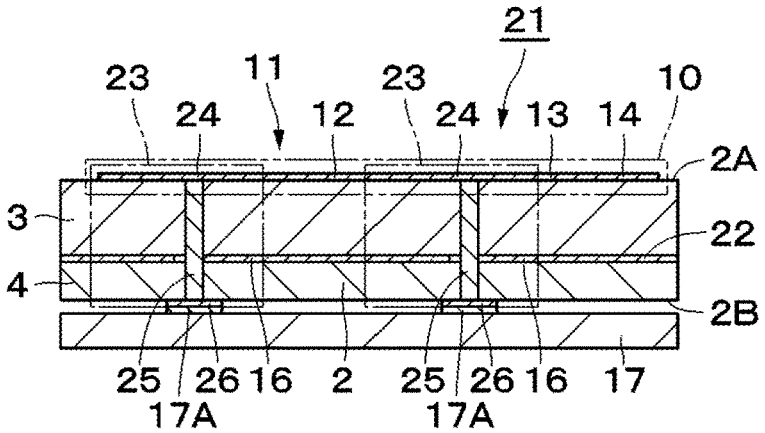
FIG. 8 is a cross-sectional view of the multiband antenna taken along an arrow direction of VIII-VIII in FIG. 6.
Figure 9:
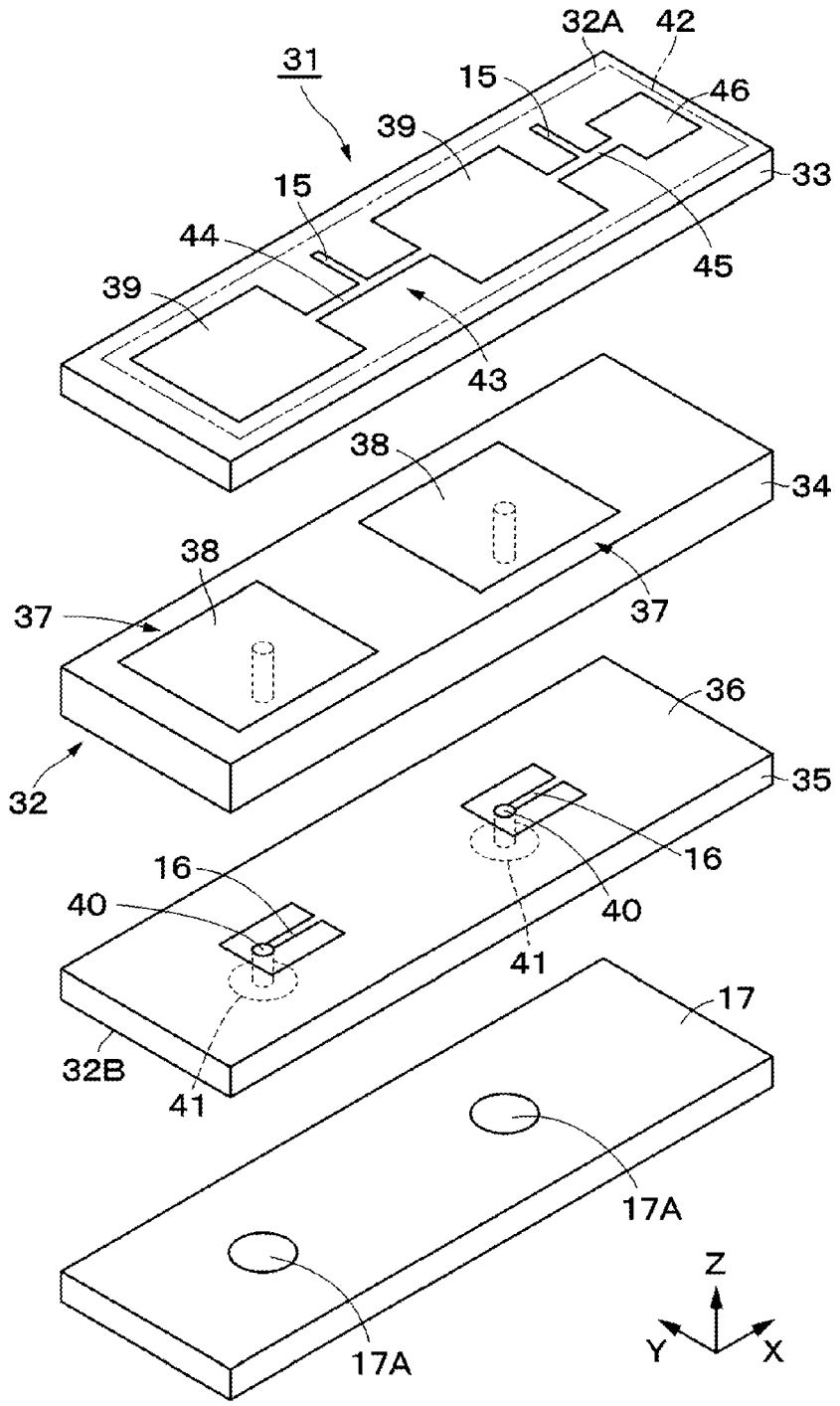
FIG. 9 is an exploded perspective view illustrating a multiband antenna according to a third embodiment.
Figure 10:
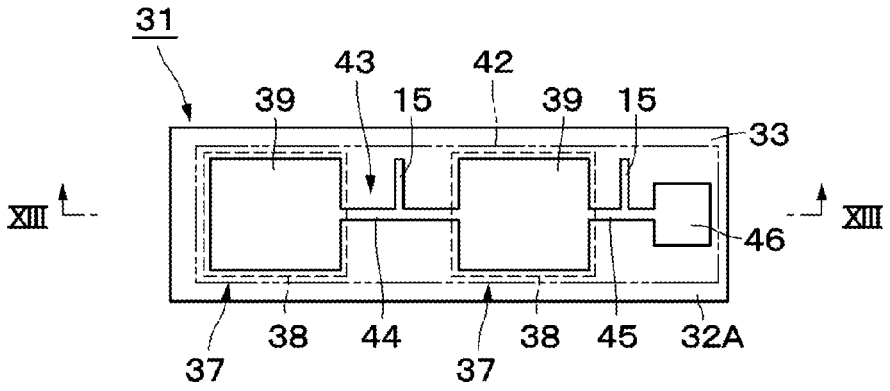
FIG. 10 is a plan view illustrating the multiband antenna shown in FIG. 9.
Figure 11:
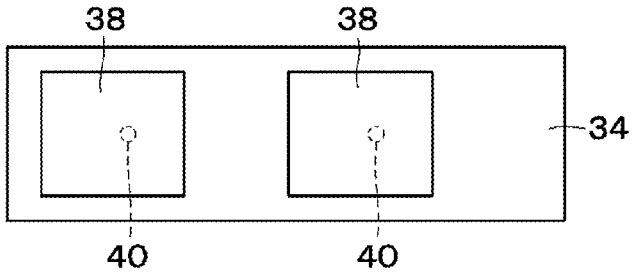
FIG. 11 is a plan view illustrating radiation elements of a high frequency antenna shown in FIG. 9.
Figure 12:
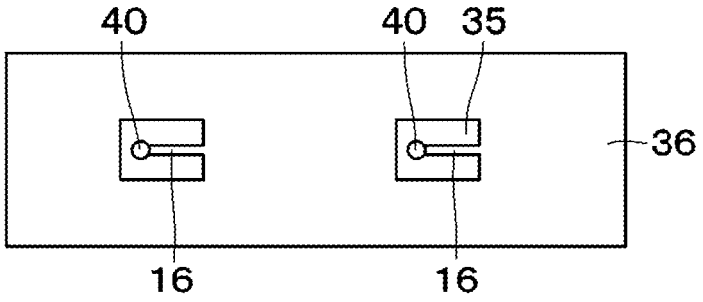
FIG. 12 is a plan view illustrating a ground layer shown in FIG. 9.
Figure 13:
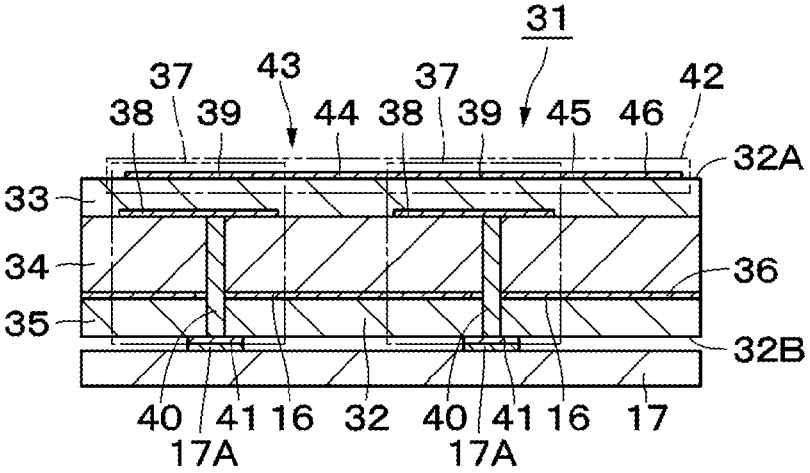
FIG. 13 is a cross-sectional view of the multiband antenna taken along an arrow direction of XIII-XIII in FIG. 10.
Figure 14:
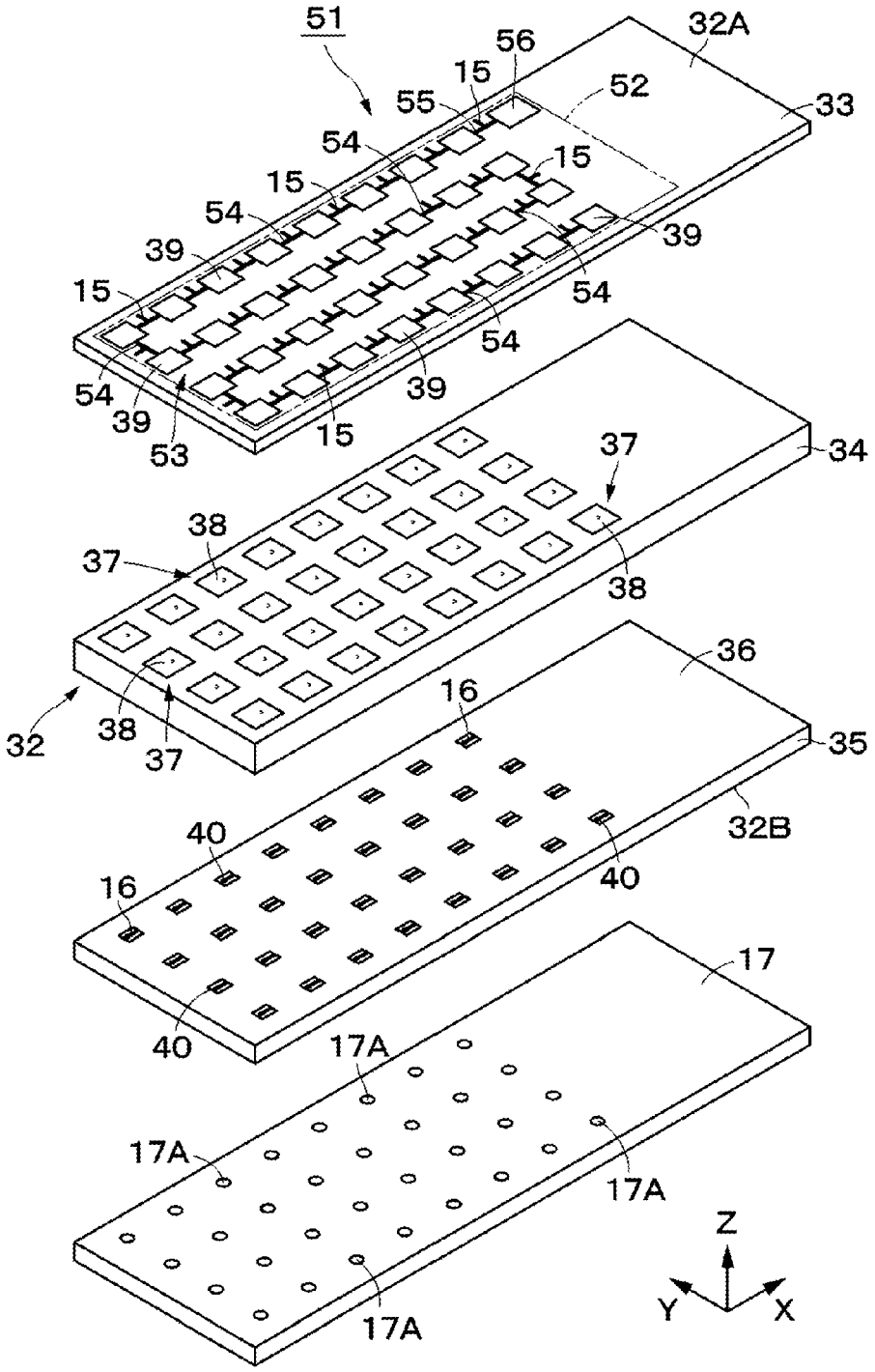
FIG. 14 is an exploded perspective view illustrating a multiband antenna according to a fourth embodiment.
Figure 15:
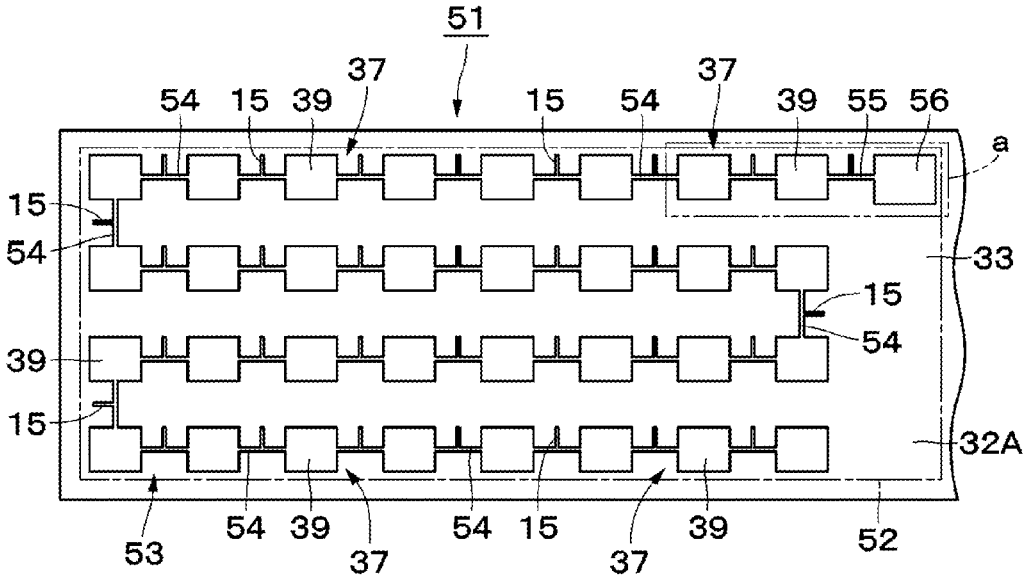
FIG. 15 is a plan view illustrating the multiband antenna shown in FIG. 14.
Figure 16:
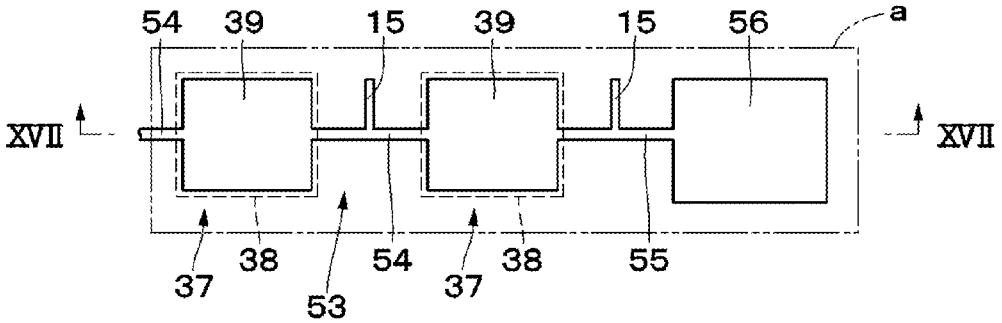
FIG. 16 is an enlarged plan view in which an "a" portion shown in FIG. 15 is enlarged and illustrated.
Figure 17:
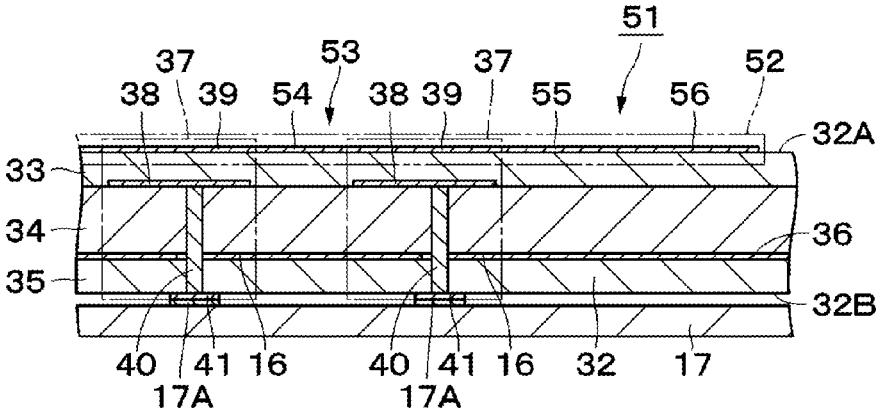
FIG. 17 is a cross-sectional view illustrating a principal portion of the multiband antenna taken along an arrow direction of XVII-XVII in FIG. 16.

Although, in FIG. 2, an example in which the series radiation element 11 linearly extends is given, it may be bent or curved. Further, the low frequency antenna 10 is not limited to a monopole antenna, and may be a dipole antenna or a linear antenna in another form. The shapes, sizes, and so on of the series radiation element 11 and the low frequency power supply line 13 are so designed as to maximize the current distribution of the low frequency power supply unit 14.

The low frequency power supply unit 14 is positioned, for example, in the periphery of the one end of the series radiation element 11 and provided on the front surface 2A of the multilayer substrate 2. The low frequency power supply unit 14 is formed with an electrode pad made of a metal thin film, for example, and electrically connected to the series radiation element 11 and the low frequency power supply line 13. The low frequency power supply unit 14 forms an input/output terminal of the low frequency signal SL and supplies the low frequency signal SL to the low frequency antenna 10. Note that the low frequency power supply unit 14 can take any form as long as it supplies the low frequency signal SL, like the case of the high frequency power supply unit 9.

The open stubs 15 are connected to the radiation element connection line 12 and the low frequency power supply line 13, respectively, so as to configure high frequency signal blocking circuits for blocking the transmission of the high frequency signal SH. To be more specific, each of the open stubs 15 is formed with an elongate belt-like conductor pattern and has a length dimension of a quarter wavelength of the high frequency signal SH, and a leading end thereof is open. With this, the open stub 15 functions as a band elimination filter that passes the low frequency signal SL and blocks the high frequency signal SH.

Although an example in which the high frequency signal blocking circuit is configured by the open stub is given, the high frequency signal blocking circuit may be configured by a short stub, a resonance circuit, a filter circuit, or the like. In other words, as long as the high frequency signal blocking circuit is configured to block the high frequency signal SH and pass the low frequency signal SL, it may be configured by any of a distributed constant circuit and a lumped constant circuit, and may be configured by any of a passive circuit and an active circuit. As such, the high frequency signal blocking circuit may be configured by substrate lines, conductor patterns, and the like, or configured by components including inductors, capacitors, and so on. Note that, however, in the case where a short stub that passes the low frequency signal SL is formed, the length dimension of the short stub needs to be set approximately to a quarter wavelength of the low frequency signal SL, which is likely to make the circuit larger. In consideration of this point, it is preferable to adopt the open stub 15 that blocks the high frequency signal SH.

The short stubs 16 are connected to the high frequency power supply lines 8 so as to configure low frequency signal blocking circuits for blocking the transmission of the low frequency signal SL. Each of the short stubs 16 is positioned between the resin layers 3 and 4, and a leading end thereof is connected to the ground layer 5, for example. To be more specific, the short stub 16 is formed with an elongate belt-like conductor pattern and has a length dimension of a quarter wavelength of the high frequency signal SH, and the leading end thereof is short-circuited. With this, the short stub 16 functions as a band pass filter that passes the high frequency signal SH and blocks the low frequency signal SL.

Although an example in which the low frequency signal blocking circuit is configured by the short stub is given, the low frequency signal blocking circuit may be configured by the open stub. Further, as long as the low frequency signal blocking circuit is configured to block the low frequency signal SL and pass the high frequency signal SH, it may be configured by a resonance circuit, a filter circuit, or the like. For example, in the case where a substrate capable of embedding components such as LTCC or the like, it is also possible to configure a low frequency signal blocking circuit using a resonance circuit or the like provided inside the substrate. However, in the case where an open stub that blocks the low frequency signal SL is formed, the length dimension of the open stub needs to be set approximately to a quarter wavelength of the low frequency signal SL, which is likely to make the circuit larger. In consideration of this point, it is preferable to adopt the short stub 16 that passes the high frequency signal SH.

A millimeter wave IC 17 is an IC in which various types of signal processing circuits and the like are integrated, and which generates the high frequency signal SH. The millimeter wave IC 17 is formed substantially in a plate-like shape and includes, on a front surface thereof, electrode pads 17A in the number corresponding to the high frequency power supply units 9. Further, the millimeter wave IC 17 is disposed on the rear surface 2B side of the multilayer substrate 2, and the electrode pads 17A thereof are jointed to the high frequency power supply units 9. With this, the millimeter wave IC 17 is electrically connected to the high frequency antennas 6 via the high frequency power supply units 9, supplies the high frequency signal SH to each of the radiation elements 7, and carries out various types of signal processing on the high frequency signal SH received by the radiation element 7.

Next, operations of the multiband antenna 1 according to the present embodiment will be described.

When power is supplied toward the radiation element 7 from the high frequency power supply unit 9, a current flows in the radiation element 7. This makes the high frequency antenna 6 radiate the high frequency signal SH corresponding to the length dimension of the radiation element 7 from the front surface 2A of the multilayer substrate 2 toward the upper side thereof and receive the high frequency signal SH.

Meanwhile, when power is supplied toward the series radiation element 11 from the low frequency power supply unit 14, a current flows in the series radiation element 11. This makes the low frequency antenna 10 radiate the low frequency signal SL corresponding to a length dimension between the other end of the series radiation element 11 (left end of the series radiation element 11 in FIG. 2) and the low frequency power supply unit 14 from the front surface 2A of the multilayer substrate 2 to the upper side thereof and receive the low frequency signal SL.

Because the open stubs 15 are connected to the radiation element connection line 12 and the low frequency power supply line 13, the transmission of the high frequency signal SH is blocked by the open stubs 15. Because of this, the high frequency signal SH will not reach the low frequency power supply unit 14 through the radiation element connection line 12, the low frequency power supply line 13, or the like, whereby characteristics, operations, and the like of the low frequency antenna 10 are stabilized. In this case, since the low frequency antenna 10 is recognized as mismatching in the high frequency signal SH band, the high frequency antennas 6 can be configured independent of the low frequency antenna 10.

In addition, because the short stubs 16 are connected to the high frequency power supply lines 8, the transmission of the low frequency signal SL can be blocked by the short stubs 16. In this case, because the high frequency power supply unit 9 is recognized as mismatching in the low frequency signal SL band, the low frequency signal SL will not reach the high frequency power supply unit 9 through the high frequency power supply line 8, whereby characteristics, operations, and the like of the high frequency antenna 6 are stabilized.

As a result, even if the plurality of radiation elements 7 are connected in series to form the series radiation element 11, each of the radiation elements 7 can function independently. Further, since the low frequency antenna 10 and the high frequency antennas 6 can be provided together in the same multilayer substrate 2, a mounting area of the antennas in the multilayer substrate 2 can be made smaller compared to a case where these antennas are individually provided. In addition, since the two high frequency antennas 6 can be made to operate being isolated from each other due to the open stub 15, the radiation elements 7 of the two high frequency antenna 6 can be connected in series to configure the series radiation element 11 of the low frequency antenna 10. This makes it possible to further increase the mounting efficiency of the high frequency antennas 6 and the low frequency antenna 10, whereby a module in which the antennas 6 and 10 are mounted can be miniaturized, a space of a terminal in which the module is installed can be saved, and so on.

Moreover, since the plurality of radiation elements 7 of the high frequency antennas 6 are connected to configure the series radiation element 11 of the low frequency antenna 10, an array antenna can be configured by the plurality of high frequency antennas 6. This makes it possible to appropriately adjust the directivity, gain, and so on of the high frequency signal SH by adjusting the phase, amplitude, and so on of the high frequency signal SH provided to each of the high frequency antennas 6.

Next, a multiband antenna 21 according to a second embodiment of the present disclosure is shown in FIGS. 5 through 8. The multiband antenna 21 is characterized in that a high frequency antenna is configured by a patch antenna. Note that in the description of the multiband antenna 21, the same constituent elements as those of the multiband antenna 1 according to the first embodiment are assigned the same reference numerals and descriptions thereof are omitted.

The multiband antenna 21 includes the multilayer substrate 2, high frequency antennas 23, the low frequency antenna 10, the open stubs 15, the short stubs 16, and the like.

There is provided a ground layer 22 at a position between the resin layers 3 and 4 inside the multilayer substrate 2. The ground layer 22 is formed with, for example, a conductive thin film of copper, silver, or the like and substantially covers the whole surface of the resin layer 4, and is connected to an external ground.

The high frequency antenna 23 is a patch antenna for the high frequency signal SH of 60 GHz band, for example. The high frequency antenna 23 includes a radiation element 24, a high frequency power supply line 25, and a high frequency power supply unit 26.

The radiation element 24 has a length dimension of a half wavelength of the high frequency signal SH in the X-axis direction, for example. The radiation element 24 is provided on the front surface 2A of the multilayer substrate 2 and is formed with an approximately rectangular conductor pattern. The high frequency power supply line 25 that is formed of a via penetrating through the multilayer substrate 2 in the thickness direction thereof is connected at a position halfway shifted in the X-axis direction from the center of the radiation element 24. The high frequency power supply line 25 is connected to the high frequency power supply unit 26 provided on the rear surface 2B of the multilayer substrate 2, and the short stub 16 is connected at a position halfway in the high frequency power supply line 25. When the high frequency signal SH is supplied via the high frequency power supply line 25, a current flows in the radiation element 24 in the X-axis direction.

Note that a plurality of the high frequency antennas 23 are provided in the multilayer substrate 2 (for example, two antennas). The radiation elements 24 of these high frequency antennas 23 linearly extend being aligned in the X-axis direction. These radiation elements 24 are connected by the radiation element connection line 12 to form the series radiation element 11 of the low frequency antenna 10. Further, the low frequency power supply unit 14 is connected to the one end side of the series radiation element 11 via the low frequency power supply line 13.

The high frequency power supply units 26 are each provided on the rear surface 2B of the multilayer substrate 2 at a position opposing the radiation element 24 of each of the high frequency antennas 23. The number of the high frequency power supply units 26 is the same as that of the high frequency antennas 23. Each of the high frequency power supply units 26 is configured with an electrode pad made of a metal thin film, for example, and electrically connected to the radiation element 24 via the high frequency power supply line 25. The high frequency power supply units 26 are jointed to the electrode pads 17A of the millimeter wave ICs 17 using a jointing method such as soldering or the like, and supply the high frequency signal SH of 60 GHz band to each of the high frequency antennas 23.

Thus, the multiband antenna 21 can give the same action effect as that obtained by the multiband antenna 1 according to the first embodiment. In addition, because the high frequency antenna 23 is configured by the patch antenna with the radiation element 24 formed in a planar shape, it is possible to transmit or receive the high frequency signal SH using the small patch antenna. Furthermore, the radiation element 24 of each patch antenna is connected to the low frequency antenna 10; as such, even in the case where the high frequency signal SH is supplied to each of the radiation elements 24, the transmission of the high frequency signal SH can be blocked by the open stub 15, whereby the low frequency antenna 10 and the high frequency antennas 23 can function independently.

Next, a multiband antenna 31 according to a third embodiment of the present disclosure is shown in FIG. 9 through 13. The multiband antenna 31 is characterized in that a high frequency antenna is configured by a stack-type patch antenna having a passive element, and a series passive element of a low frequency antenna is formed by connecting a plurality of passive elements in series. Note that in the description of the multiband antenna 31, the same constituent elements as those of the multiband antenna 1 according to the first embodiment are assigned the same reference numerals and descriptions thereof are omitted.

The multiband antenna 31 includes a multilayer substrate 32, high frequency antennas 37, a low frequency antenna 42, the open stubs 15, the short stubs 16, and the like.

Almost like the multilayer 2 according to the first embodiment, the multilayer substrate 32 is formed in a plate shape parallel to an X-Y plane extending in an X-axis direction and a Y-axis direction among the X-axis direction, the Y-axis direction, and a Z-axis direction perpendicular to one another. Note that, however, the multilayer substrate 32 is a print board in which three layers, that is, resin layers 33 through 35 are laminated as insulation layers in a direction from a front surface 32A side toward a rear surface 32B side, for example. A ground layer 36 formed with a conductive thin film of copper, silver, or the like is provided between the resin layers 34 and 35 while substantially covering the whole surface of the resin layer 35, for example, and is connected to an external ground.

The high frequency antenna 37 is a stack-type patch antenna for the high frequency signal SH of 60 GHz band, for example. The high frequency antenna 37 includes a radiation element 38, a passive element 39, a high frequency power supply line 40, and a high frequency power supply unit 41.

The radiation element 38 is configured substantially in the same manner as the radiation element 24 according to the second embodiment, and has a length dimension of a half wavelength of the high frequency signal SH in the X-axis direction, for example. The radiation element 38 is provided between the resin layers 33 and 34 of the multilayer substrate 32, and is formed with a substantially rectangular conductor pattern. The high frequency power supply line 40 that is formed of a via penetrating through the resin layers 34 and 35 is connected at a position halfway shifted in the X-axis direction from the center of the radiation element 38. The high frequency power supply line 40 is connected to the high frequency power supply unit 41 provided on the rear surface 32B of the multilayer substrate 32, and the short stub 16 is connected at a position hallway in the high frequency power supply line 40. In this case, the short stub 16 is provided between the resin layers 34 and 35 along with the ground layer 36.

The passive element 39 is laminated on a front surface of the radiation element 38 with the resin layer 33 interposed therebetween. The passive element 39 is formed in a substantially rectangular shape, which is the same shape as the radiation element 38, on the front surface 32A of the multilayer substrate 32, that is, a front surface of the resin layer 33. An electromagnetic field coupling is generated between the radiation element 38 and the passive element 39 opposing each other with the resin layer 33 interposed therebetween. Although, in FIG. 10, an example in which the passive element 39 is smaller than the radiation element 38 is given, the dimensions of the passive element 39 in the X-axis direction and the Y-axis direction may be larger or smaller than the dimensions of the radiation element 38 in the X-axis direction and the Y-axis direction, for example. A relation in size between the radiation element 38 and the passive element 39, specific shapes thereof, and the like are appropriately set in consideration of the radiation pattern, the band, and so on of the high frequency antenna 37.

A plurality of the high frequency antennas 37 are provided in the multilayer substrate 32 (for example, two antennas). The radiation elements 38 as well as the passive elements 39 of the high frequency antennas 37 linearly extend being aligned in the X-axis direction.

The high frequency power supply units 41 are each provided on the rear surface 32B of the multilayer substrate 32 at a position opposing the radiation element 38 of each of the high frequency antennas 37. The number of the high frequency power supply units 41 is the same as that of the high frequency antennas 37. Each of the high frequency power supply units 41 is configured with an electrode pad made of a metal thin film, for example, and is electrically connected to the radiation element 38 via the high frequency power supply line 40. The high frequency power supply units 41 are jointed to the electrode pads 17A of the millimeter wave ICs 17, and supply the high frequency signal SH of 60 GHz band to each of the high frequency antennas 37.

The low frequency antenna 42 is configured substantially in the same manner as the low frequency antenna 10 according to the first embodiment, and is a monopole antenna for the low frequency signal SL at a lower frequency than that of the high frequency signal SH (for example, several GHz to several tens of GHz). The low frequency antenna 42 includes a series passive element 43, a low frequency power supply line 45, and a low frequency power supply unit 46.

The series passive element 43 is formed by connecting the plurality of passive elements 39 in series, and is provided on the front surface 32A of the multilayer substrate 32. In this case, two adjacent radiation elements 39 are connected by a passive element connection line 44. In addition, the low frequency power supply unit 46 is connected to one end side of the series passive element 43 (right end side of the series passive element 43 in FIG. 10) via the low frequency power supply line 45.

The passive element connection line 44 and the low frequency power supply line 45 are each formed with an elongate belt-like conductor pattern and provided on the front surface 32A of the multilayer substrate 32. In this case, a length between the other end of the series passive element 43 and the low frequency power supply unit 46 is set to a dimension of a quarter wavelength of the low frequency signal SL in the X-axis direction, for example. Further, the open stubs 15 are connected to the passive element connection line 44 and the low frequency power supply line 45.

The low frequency power supply unit 46 is configured substantially in the same manner as the low frequency power supply unit 14 according to the first embodiment. The low frequency power supply unit 46 is positioned, for example, in the periphery of the one end of the series passive element 43 and provided on the front surface 32A of the multilayer substrate 32. The low frequency power supply unit 46 is formed with an electrode pad made of a metal thin film, for example, and electrically connected to the series passive element 43 via the low frequency power supply line 45. The low frequency power supply unit 46 comprises an input/output terminal of the low frequency signal SL, and supplies the low frequency signal SL to the low frequency antenna 42.

Thus, the multiband antenna 31 can give the same action effect as that obtained by the multiband antenna 1 according to the first embodiment. In addition, because the high frequency antenna 37 is configured by the stack-type patch antenna in which the passive element 39 faces to and is provided on the front surface of the radiation element 38, it is possible to widen the band of the high frequency antenna 37 in comparison with a case where the passive element 39 is omitted. Further, because the series passive element 43 of the low frequency antenna 42 is formed by connecting the passive elements 39 in series, the low frequency antenna 42 and the radiation elements 38 of the high frequency antennas 37 are not directly connected to each other, but indirectly connected through capacitance between the radiation elements 38 and the passive elements 39. This makes it possible to reduce the low frequency signal SL travelling toward the high frequency power supply unit 41 and further stabilize the characteristics, operations, and so on of the high frequency antenna 37.

Next, a multiband antenna 51 according to a fourth embodiment of the present disclosure is shown in FIGS. 14 through 17. The multiband antenna 51 is characterized in that a series passive element radiates low frequency signals of different wave lengths. Note that in the description of the multiband antenna 51, the same constituent elements as those of the multiband antenna 31 according to the third embodiment are assigned the same reference numerals and descriptions thereof are omitted.

The multiband antenna 51 includes the multilayer substrate 32, the high frequency antennas 37, a low frequency antenna 52, the open stubs 15, the short stubs 16, and the like.

A plurality of the high frequency antennas 37 are provided being aligned in array form on the multilayer substrate 32. An example in which thirty-two high frequency antennas 37 in total are provided in the form of an array with 4 rows and 8 columns is given in FIG. 15.

The low frequency antenna 52 is a monopole antenna for two low frequency signals SL1 and SL2 of 5 GHz and 2.4 GHz bands, lower in frequency than the high frequency signal SH; these frequency bands are used in Wi-Fi (Wireless Fidelity), for example. The low frequency antenna 52 includes a series passive element 53, a low frequency power supply line 55, and a low frequency power supply unit 56.

The series passive element 53 is provided on the front surface 32A of the multilayer substrate 32 and formed by connecting the plurality of passive elements 39 in series (for example, twenty-four elements). In this case, two adjacent passive elements 39 are connected by a passive element connection line 54. With this, the series passive element 53 winds in meander form reciprocating in the X-axis direction, for example. The low frequency power supply unit 56 is connected to, via the low frequency power supply line 55, one end side of the series passive element 53 (upper-right end side of the series passive element 53 in FIG. 15).

The passive element connection lines 54 and the low frequency power supply line 55 are each formed with an elongate belt-like conductor pattern and provided on the front surface 32A of the multilayer substrate 32. The open stubs 15 are connected to each of the passive element connection lines 54 and the low frequency power supply line 55.

In this case, a length between the other end of the series passive element 53 (lower-right end of the series passive element 53 in FIG. 15) and the low frequency power supply unit 56 is set to a dimension such that the low frequency signal SL2 of 2.4 GHz band resonates in a plurality of modes, for example. Specifically, the length between the other end of the series passive element 53 and the low frequency power supply unit 56 is set to a dimension of an approximately quarter wavelength of the low frequency signal SL2. As such, the series passive element 53 and the low frequency power supply line 55 resonate to the low frequency signal SL2 of 2.4 GHz band, and also resonate to the low frequency signal SL1 of 5 GHz band as a signal near a harmonic of twice the 2.4 GHz band. This makes the series passive element 53 radiate the low frequency signals SL1 and SL2 of different frequencies.

The low frequency power supply unit 56 is configured substantially in the same manner as the low frequency power supply unit 14 according to the first embodiment. The low frequency power supply unit 56 is positioned, for example, in the periphery of the one end of the series passive element 53 and provided on the front surface 32A of the multilayer substrate 32. The low frequency power supply unit 56 is formed with an electrode pad made of a metal thin film, for example, and electrically connected to the series passive element 53 via the low frequency power supply line 55. The low frequency power supply unit 56 comprises an input/output terminal of the low frequency signals SL1 and SL2, and supplies the low frequency signals SL1 and SL2 to the low frequency antenna 52.

Thus, the multiband antenna 51 can give the same action effect as that obtained by the multiband antenna 1 according to the first embodiment and the multiband antenna 31 according to the third embodiment. In addition, because the plurality of high frequency antennas 37 are disposed in plane form extending in the X-axis direction and Y-axis direction, the high frequency signal SH can be radiated while scanning not only in the X-axis direction but also in the Y-axis direction, whereby an adjustment range of directivity or the like of the high frequency signal SH can be widened. Further, because the low frequency antenna 52 can be used for the plurality of low frequency signals of different frequencies, that is, SL1 and SL2, it is possible to configure the multiband antenna 51 that can be shared with the plurality of low frequency signals, that is, SL1 and SL2, in addition to the high frequency signal SH.

Note that in the fourth embodiment, a case of using the high frequency antenna 37 according to the third embodiment is exemplified. However, the present disclosure is not intended to be limited thereto, and like in a multiband antenna 61 according to a variation shown in FIG. 18, the high frequency antenna 23 according to the second embodiment may be used. In this case, in a low frequency antenna 62, a series radiation element 63 is formed through connecting the plurality of radiation elements 24 in series by radiation element connection lines 64, and one end side of the series radiation element 63 is connected to a low frequency power supply unit 66 via a low frequency power supply line 65. Further, a length between the other end of the series radiation element 63 and the low frequency power supply unit 66 is set to a dimension such that a low frequency signal resonates in a plurality of modes, whereby low frequency signals of different frequencies are radiated from the series radiation element 63. This variation may be configured using the high frequency antenna 6 according to the first embodiment.

Figure 19:
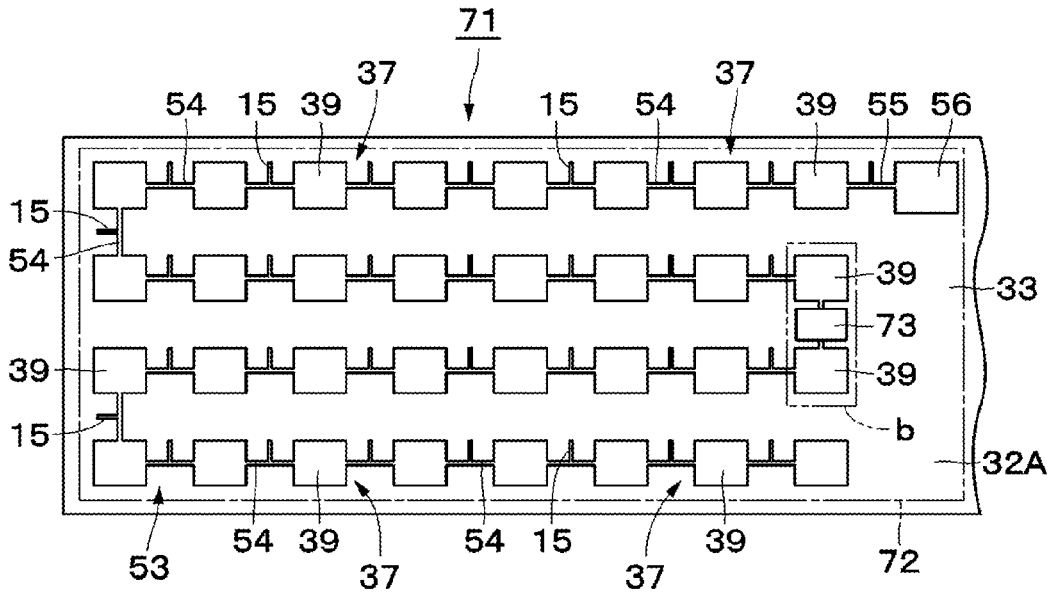
FIG. 19 is a plan view illustrating a multiband antenna according to a fifth embodiment.
Figure 20:
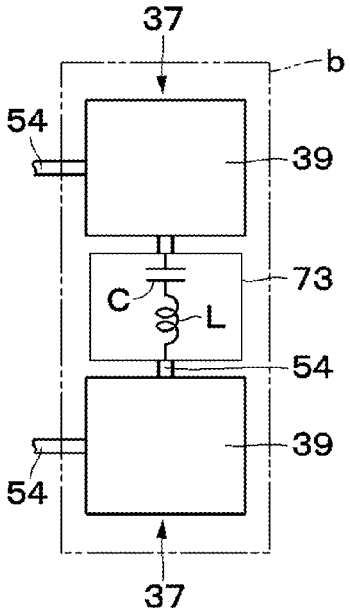
FIG. 20 is an enlarged plan view in which a "b" portion shown in FIG. 19 is enlarged and illustrated.

Next, a multiband antenna 71 according to a fifth embodiment of the present disclosure is shown in FIGS. 19 and 20. The multiband antenna 71 is characterized in that a matching circuit in place of a high frequency blocking circuit is provided to any one of passive element connection lines. Note that in the description of the multiband antenna 71, the same constituent elements as those of the multiband antenna 51 according to the fourth embodiment are assigned the same reference numerals and descriptions thereof are omitted.

The multiband antenna 71 includes the multilayer substrate 32, the high frequency antennas 37, a low frequency antenna 72, the open stubs 15, the short stubs 16, and the like.

A series resonance circuit 73 that is configured of, for example, an inductor L and a capacitor C and serves as a matching circuit for the low frequency signal SL2 on the lower frequency side, is provided and connected in place of the open stub 15 to any one of the passive element connection lines 54 in the low frequency antenna 72.

The series resonance circuit 73 is disposed, within the series passive element 53, at a position corresponding to a quarter wavelength of the low frequency signal SL1 on the higher frequency side, for example. In this case, a portion of the low frequency antenna 72 between the low frequency power supply unit 56 and the series resonance circuit 73 resonates to the low frequency signal SL1 of 5 GHz band, while the whole low frequency antenna 72 resonates to the low frequency signal SL2 of 2.4 GHz band.

In this case, by changing the capacitance of the capacitor C in the series resonance circuit 73, the frequency in use can be fine-tuned. The characteristics are deteriorated due to matching loss of the series resonance circuit 73 in some case. However, even if the low frequency signal SL1 and the low frequency signal SL2 are not related with harmonics, the low frequency antenna 72 can be made to resonate to the two low frequency signals SL1 and SL2.

Thus, the multiband antenna 71 can give the same action effect as that obtained by the multiband antenna 1 according to the first embodiment and the multiband antenna 31 according to the third embodiment.

Note that the matching circuit is not limited to the series resonance circuit 73, and can be configured by various kinds of lumped constant circuits or distributed constant circuits. Further, although an example in which one open stub 15 is replaced with a matching circuit (series resonance circuit 73) is given in the fifth embodiment, two or more open stubs 15 may be replaced with matching circuits. In this case, switching circuits may be provided parallel to each of a plurality of matching circuits (for example, three or more matching circuits), and the length of the low frequency antenna may be changed by switching ON/OFF the respective switching circuits as needed. This makes it possible to select a plurality of frequencies.

Figure 18:
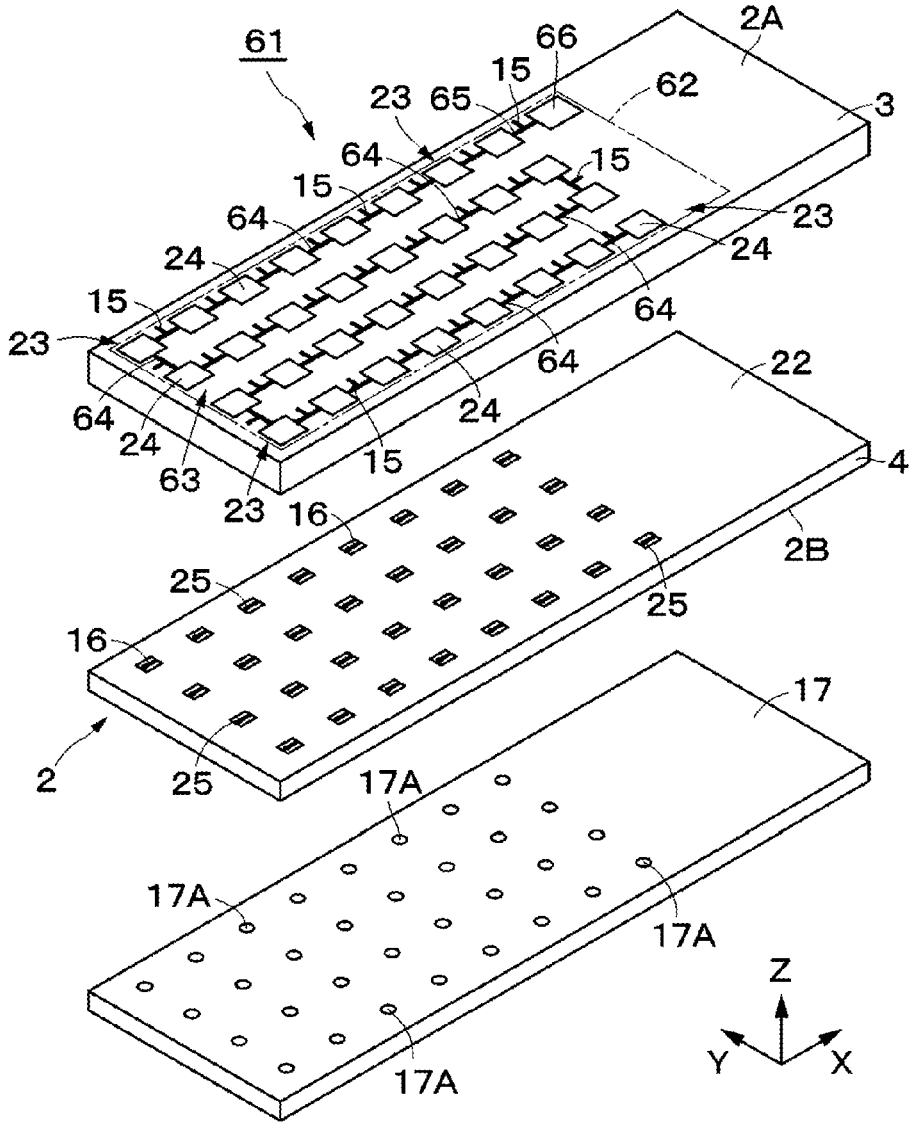
FIG. 18 is an exploded perspective view illustrating a multiband antenna according to a variation.

The fifth embodiment can be applied not only to the fourth embodiment but also to the variation shown in FIG. 18, and can be further applied to a configuration in which the high frequency antenna 6 according to the first embodiment is used.

Although, in the fourth and fifth embodiments, examples in which the high frequency antennas 37 are disposed in plane form extending in the X-axis direction and Y-axis direction are given, these antennas may be linearly disposed being aligned in a line like in the first through third embodiments. On the other hand, in the first through third embodiments, although examples in which the high frequency antennas 6, 23, and 37 are linearly disposed are given, these antennas may be disposed in plane form like in the fourth and fifth embodiments.

Further, in the respective configurations of the above embodiments, the short stubs 16 as the low frequency signal blocking circuits are connected to the high frequency power supply lines 8, 25, and 40. However, the present disclosure is not limited thereto; that is, like the high frequency antennas 37 according to the third through fifth embodiments, for example, the radiation elements 38 may be indirectly connected to the low frequency antennas 42, 52, and 72, and the short stubs 16 may be omitted in the case where influence of the low frequency signal SL on the high frequency antennas 37, the high frequency power supply units 9, 26 and 41, and the like is small.

In the respective configurations of the above embodiments, a current flows in the X-axis direction in any of the radiation elements 7, 24, and 38 in the plurality of respective high frequency antennas, that is, the high frequency antennas 6, 23, and 37. However, the currents may flow in different directions from each other. In other words, the plurality of high frequency antennas may all perform the same polarization or individually perform different polarizations.

In the first and second embodiments, the multilayer substrate 2 in which the resin layers 3 and 4 are laminated to form two insulation layers is used, while in the third through fifth embodiments, the multilayer substrate 32 in which the resin layers 33 through 35 are laminated to form three insulation layers is used. However, the number of insulation layers can be appropriately changed as needed.

In the above embodiments and the variation, although cases in which the multiband antennas 1, 21, 31, 51, 61, and 71 are each formed in the multilayer substrate 2 or 32 are exemplified and explained, these multiband antennas may be each formed in a single-layer substrate. Further, the multiband antennas may have a structure formed by only bending a metal plate without a substrate being provided.

Furthermore, although examples of the high frequency antennas 6, 23, and 37 using, for example, a millimeter wave of 60 GHz band are given above, it is needless to say that the high frequency antennas may use millimeter waves of other frequency bands, microwaves, and so on. Likewise, the low frequency antennas 10, 42, 52, 62, and 72 are not limited to the aforementioned frequencies to be used, and may use millimeter waves of other frequency bands, microwaves, and so on.

1, 21, 31, 51, 61, 71 MULTIBAND ANTENNA
2, 32 MULTILAYER SUBSTRATE
3, 4, 33-35 RESIN LAYER (INSULATION LAYER)
5, 22, 36 GROUND LAYER
6, 23, 37 HIGH FREQUENCY ANTENNA
7, 24, 38 RADIATION ELEMENT
8, 25, 40 HIGH FREQUENCY POWER SUPPLY LINE
9, 26, 41 HIGH FREQUENCY POWER SUPPLY UNIT
10, 42, 52, 62, 72 LOW FREQUENCY ANTENNA
11, 63 SERIES RADIATION ELEMENT
12, 64 RADIATION ELEMENT CONNECTION LINE
13, 45, 55, 65 LOW FREQUENCY POWER SUPPLY LINE
14, 46, 56, 66 LOW FREQUENCY POWER SUPPLY UNIT
15 OPEN STUB (HIGH FREQUENCY SIGNAL BLOCKING CIRCUIT)
16 SHORT STUB (LOW FREQUENCY SIGNAL BLOCKING CIRCUIT)
17 MILLIMETER WAVE IC
39 PASSIVE ELEMENT
43, 53 SERIES PASSIVE ELEMENT
44, 54 PASSIVE ELEMENT CONNECTION LINE
73 SERIES RESONANCE CIRCUIT (MATCHING CIRCUIT)

The invention claimed is:

1. A multiband antenna comprising:
at least two radiation elements;
high frequency power supply units configured to supply a high frequency signal to the respective radiation elements;
passive elements that are provided opposing the respective radiation elements;
passive element connection lines that connect the passive elements in series to form a series passive element;
a low frequency power supply unit connected to one end side of the series passive element via a low frequency power supply line and configured to supply a low frequency signal; and
high frequency blocking circuits connected to the passive element connection lines and the low frequency power supply line, and configured to block transmission of the high frequency signal,
wherein the high frequency signal is radiated from the radiation element, and
the low frequency signal is radiated from the series passive element.

2. The multiband antenna according to claim 1,
wherein the radiation elements and the high frequency power supply units are connected by high frequency power supply lines, and
low frequency signal blocking circuits configured to block transmission of the low frequency signal are connected to each of the high frequency power supply lines.

3. The multiband antenna according to claim 1,
wherein there is provided an insulation layer between the radiation elements and the series passive element.

4. The multiband antenna according to claim 1,
wherein a length between another end of the series passive element and the low frequency power supply unit is set to a dimension such that the low frequency signal resonates in a plurality of modes, and
low frequency signals of different wave lengths are radiated from the series passive element.

5. The multiband antenna according to claim 1,
wherein at least one matching circuit in place of the high frequency blocking circuit is provided to any one of the passive element connection lines, and
low frequency signals of different wave lengths are radiated from the series passive element.

* * * * *